US008061149B1

(12) United States Patent
Gowans et al.

(10) Patent No.: US 8,061,149 B1
(45) Date of Patent: Nov. 22, 2011

(54) TEMPERATURE CONTROL CASE

(75) Inventors: Andrew Ross Gowans, Salt Lake City, UT (US); Mike George Orfanakis, Salt Lake City, UT (US); Brent Kelvin Speirs, Sandy, UT (US); Ryan Derek Clark, West Jordan, UT (US)

(73) Assignee: Case In Point LLC, Sandy, UT (US)

( * ) Notice: Subject to any disclaimer, the term of this patent is extended or adjusted under 35 U.S.C. 154(b) by 660 days.

(21) Appl. No.: 12/184,883

(22) Filed: Aug. 1, 2008

Related U.S. Application Data

(63) Continuation-in-part of application No. 12/016,024, filed on Jan. 17, 2008, now abandoned.

(60) Provisional application No. 60/887,965, filed on Feb. 2, 2007.

(51) Int. Cl.
*F25B 21/02* (2006.01)

(52) U.S. Cl. ..... 62/3.62; 62/371

(58) Field of Classification Search ..... 62/3.62, 62/3.7, 371, 372, 457.2
See application file for complete search history.

(56) References Cited

U.S. PATENT DOCUMENTS

| | | | | |
|---|---|---|---|---|
| 3,255,812 | A * | 6/1966 | Bayane et al. | 165/265 |
| 4,407,133 | A | 10/1983 | Edmonson | |
| 5,217,064 | A | 6/1993 | Kellow et al. | |
| 5,572,873 | A | 11/1996 | Lavigne et al. | |
| 5,603,220 | A * | 2/1997 | Seaman | 62/3.7 |

* cited by examiner

*Primary Examiner* — Melvin Jones
(74) *Attorney, Agent, or Firm* — Kory D. Christensen; Matthew D. Thayne; Stoel Rives LLP

(57) ABSTRACT

Embodiments of a temperature control case and related methods and systems are disclosed. Some embodiments may be particularly useful for portable storage of temperature-sensitive pharmaceutical substances and the like. Embodiments are also disclosed which are configured specifically for cooling intravenous fluids to be used for therapeutic hypothermia. Some embodiments may include multiple storage compartments each being configured to store substances at a different temperature so that intravenous fluids can be stored in one compartment and other substances in another compartment. Some embodiments include both internal and external temperature sensors to allow the device to predict internal temperature changes and adjust heating/cooling elements accordingly before the internal temperature is unduly impacted by the ambient temperature, thereby increasing the efficiency and efficacy of the temperature control system.

21 Claims, 6 Drawing Sheets

TEMPERATURE CONTROL CASE

RELATED APPLICATIONS

This application is a continuation-in-part of U.S. patent application Ser. No. 12/016,024, filed Jan. 17, 2008, and titled "Temperature Control Case," which claims the benefit under 35 U.S.C. §119(e) of U.S. Provisional Patent Application No. 60/887,965, filed Feb. 2, 2007, and titled "Temperature Control Case." Both of the aforementioned patent references are incorporated herein by specific reference in their entireties.

BRIEF DESCRIPTION OF THE DRAWINGS

Understanding that drawings depict only certain preferred embodiments and are not therefore to be considered to be limiting in nature, the preferred embodiments will be described and explained with additional specificity and detail through the use of the accompanying drawings in which.

DETAILED DESCRIPTION OF PREFERRED EMBODIMENTS

Figure 2:
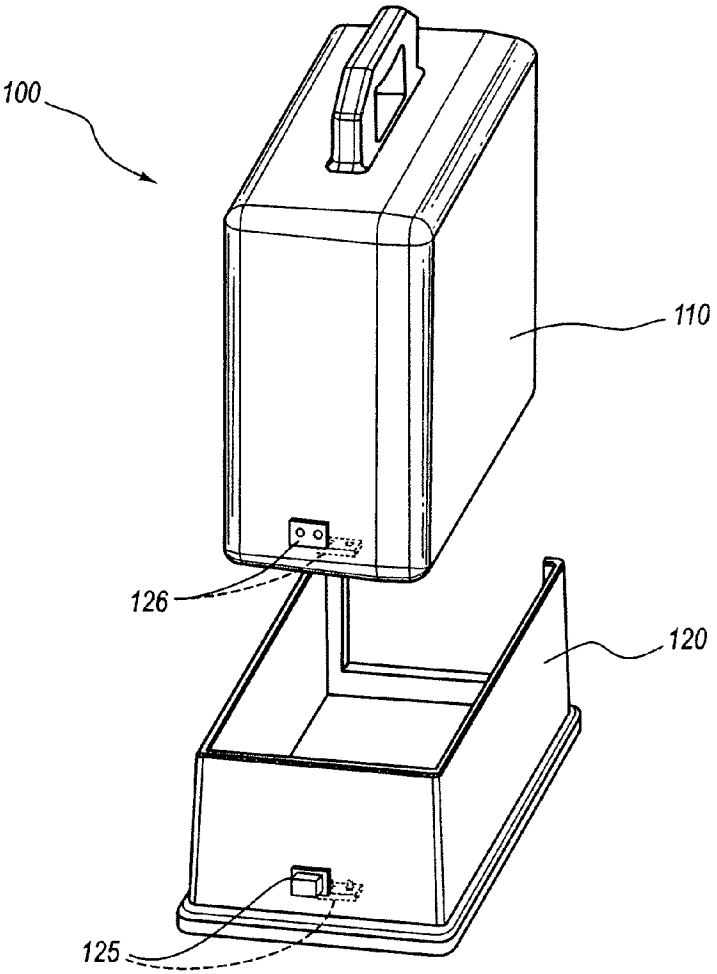
FIG. 2 is another perspective view of the temperature control case system shown in FIG. 1.

In the following description, numerous specific details are provided for a thorough understanding of specific preferred embodiments. However, those skilled in the art will recognize that the invention can be practiced without one or more of the specific details, or with other methods, components, materials, etc.

In some cases, well-known structures, materials, or operations are not shown or described in detail in order to avoid obscuring aspects of the preferred embodiments. Furthermore, the described features, structures, or characteristics may be combined in any suitable manner in one or more embodiments.

Disclosed are embodiments of a temperature control case and related methods and systems. Some embodiments of the invention may be particularly useful for portable storage of temperature-sensitive substances, such as pharmaceuticals and the like. This may be accomplished by providing a case with a battery-operated temperature control system with, for example, a peltier cooler. One or more temperature sensors may also be provided. Some embodiments include both internal and external temperature sensors to increase the efficiency and efficacy of the temperature control system. Providing an ambient or external temperature sensor may allow for better control over the internal temperature of the device, and therefore better control over the temperature of the drugs, etc., stored by the case. An internal storage compartment may also be provided. The compartment may be insulated and compartmentalized for efficient and convenient storage of medication.

In some embodiments of the invention, seamless power switching may be provided. In other words, the case may be configured to monitor the power sources available and switch to the proper source without any intervention by the user. For example, when the unit is plugged in to an external power source, the device may be configured to detect that power is available externally and, accordingly, switch off the battery power. Once the battery power has been switched off, the battery may also be charged via the external power source. In other words, when the case is plugged into external power, it not only has the ability to operate using the external power source, but the external power source can also simultaneously charge the battery. When external power is removed, the device may be configured to detect the loss of power and switch the power control back to the battery.

Some embodiments of the invention provide a mounting bracket that may be positioned within a vehicle and connected to a power source. When the portable case is inserted into the mounting bracket, contact is made with the power source via one or more electrical connectors, the case draws from an external power source coupled with the electrical connectors on the mounting bracket, and charging of the battery begins automatically. Upon removal of the case from the bracket, contact with external power source is lost and the case automatically reverts to its battery power. In some embodiments, a release mechanism, such as a button or switch, may be provided to disconnect the case from the mounting bracket. This may be provided to prevent unintentional disengagement of the case during travel, for example.

In some embodiments of the invention, intelligent temperature monitoring may also be provided. Temperature monitoring may be facilitated by providing one or more thermistors or other temperature sensors. Such sensors may be positioned inside the case where the temperature-sensitive substances are stored. Alternatively, or additionally, sensors may be positioned on the outside of the unit to detect external or ambient temperatures. Providing external temperature sensors along with internal temperature sensors may allow the device to operate more efficiently and keep a more precise temperature within the case.

To illustrate, the temperature inside the case must change before an internal sensor can detect the change and update the CPU on temperature conditions. However, it may be desirable to minimize temperature change inside the case to maintain a more stable temperature condition. It may therefore be desirable to provide external as well as internal sensors, the external sensors being used to predict a temperature change inside the case and act to prevent or at least reduce the extent of the change before it actually happens.

Accordingly, some embodiments of the invention provide multiple temperature sensors and may also utilize complex methods to detect, report, and maintain temperature. One temperature sensor may be positioned inside the case, while another may be mounted outside of the case, or at least outside of a cavity or compartment in the case within which medication is stored. It may be desirable to place this external sensor beyond the case's insulation to allow it to measure the ambient air temperature. By providing internal and external temperature sensors, the CPU can monitor the outside air temperature and plan a course of action to maintain an acceptable temperature within the case before the external temperature swings have a chance to unduly affect the internal case temperature. In some embodiments of the invention, duty cycle adjustments on heating and/or cooling elements (collectively referred to herein as "temperature maintenance elements") may be used to accomplish this.

For example, if the preset internal temperature is set to 60 degrees Fahrenheit and the ambient air temperature is 90 degrees Fahrenheit, the CPU knows by taking both internal and external temperature measurements that it needs to remain in a cooling condition, even if the internal temperature is at the preset or desired temperature. The CPU may monitor the fluctuations in both internal and external air temperature and adjust how much power is provided to the cooling and/or heating element(s) as needed. In some embodiments and conditions, these adjustments may be made hundreds of times per second. If the internal temperature continues to decline (or increase, if the heating element is in operation) after reaching the desired preset temperature, the CPU may be configured to decrease the power to the cooling element without completely shutting it off. In this manner, the cooling element may be kept cold at all times if desired, which reduces the lag time of correcting the temperature. Maintaining variable power to the cooling element without shutting it off completely also helps to conserve the battery when the internal temperature needs to be maintained, but not changed.

Some embodiments of the invention may also provide for strategic placement of one or more internal sensors. For example, an internal sensor may be positioned to detect the temperature of a gel pack or another liquid within the case. By placing a sensor in the case such that it contacts a gel pack, the sensor may report a temperature that is closer to the temperature of the liquid medications contained in the case than the internal air temperature would be. One or more sensors may be placed inside of the gel pack, or, alternatively, the sensors may be placed adjacent to and in contact with the gel pack.

In some embodiments, the portable case may be configured specifically for cooling intravenous fluid to induce therapeutic hypothermia. For example, one or more compartments within a case may be configured to be separately cooled so as to maintain an appropriate temperature for storing intravenous fluids that will be used to for performing therapeutic hypothermia. In preferred embodiments, this compartment will be maintained at a temperature of between 28 and 40 degrees Fahrenheit. In some such embodiments, the one or more compartments for storing hypothermic fluids may be maintained at between 31 and 40 degrees Fahrenheit. In some such embodiments, the one or more compartments for storing hypothermic fluids may be maintained at between 32 and 35 degrees Fahrenheit.

In embodiments that are configured to facilitate storing fluids to be used for therapeutic hypothermia, the one or more compartments used for storing the hypothermic fluids may be lined with insulation, or with added insulation relative to any other compartments within the case. In addition, the case may include one or more components to facilitate providing pressure infusion of intravenous solutions. For example, one or more of the pressure infusion components disclosed in U.S. Patent Application Publication No. 2005/0070845 titled "Method and Apparatus for Pressure Infusion and Temperature Control of Infused Liquids" may be incorporated into various embodiments of the cases disclosed herein. This published patent application is hereby incorporated by reference in its entirety.

Embodiments are also contemplated which include multiple compartments. In such embodiments, some of the compartments may be configured to receive and store substances at a different temperature than other compartments. In such embodiments, separate internal temperature sensors may be provided in each of the compartments for which a desired temperature or temperature range varies from another compartment. Of course, separate cooling and/or heating elements may also be provided in each of the compartments for which a desired temperature or temperature range varies from another compartment. Alternatively, other embodiments may be configured to only provide for cooling of intravenous fluids, in which case only a single internal sensor may be needed. In such embodiments, an external or ambient sensor may, but need not, also be provided.

In an example of an embodiment having separate compartments configured to receive and store substances at different temperatures, a case may be provided comprising a base and a lid configured to enclose the base. At least one of the lid and the base may at least partially define a first internal storage compartment, and at least one of the lid and the base may also at least partially define a separate, second internal storage compartment. One of the first and second internal storage compartments may be configured to receive and store an intravenous solution and the other may be configured to receive and store a pharmaceutical substance at a different temperature. As such, a first cooling element may be provided that is configured to lower an internal temperature within at least a portion of the first internal storage compartment. Optionally, a heating element configured to raise an internal temperature within at least a portion of the first internal storage compartment may also be provided. Likewise, a second cooling element (and heating element, if desired) may be provided to maintain the internal temperature within at least a portion of the second internal storage compartment (assuming the second compartment is used to store intravenous solutions) at an appropriate temperature such that the intravenous solution can be used for therapeutic hypothermia treatment.

In some embodiments, an ambient temperature sensor will also be provided, which is configured to sense an external temperature outside of the case. A user interface may also be provided to allow a user to select a desired target temperature for at least a portion of at least one of the internal storage compartments. In some embodiments, the user interface may allow for separate selection of temperatures for each of the separate compartments.

A temperature control unit may also be provided to receive temperature data from the ambient temperature sensor and at least one of the internal temperature sensors to control operation of the cooling and/or heating elements so as to adjust an internal temperature within at least a portion of at least one of the internal storage compartments. In some embodiments, the temperature control unit may comprise a plurality of operation modes. For example, an operation mode of the cooling unit or temperature control unit may be entered or altered when an internal temperature sensed by an internal temperature sensor varies from a target temperature range by at least a first amount. Alternatively, or additionally, the temperature control unit may be configured to alter an operation mode of the cooling unit when an external temperature sensed by the ambient temperature sensor varies from a target temperature range by at least a second amount. The temperature control unit may also be configured to select an operation profile based upon the temperature difference between the external temperature sensed by the ambient temperature sensor and at least one of a target temperature selected by the user and an internal temperature sensed by an internal temperature sensor.

The temperature control unit may also be provided with a change temperature mode, wherein the temperature control unit is configured to enter the change temperature mode when an internal temperature sensed by a first internal temperature sensor differs from a target temperature selected by a user by at least a first amount. The change temperature mode may also comprise a plurality of operation profiles, each of the operation profiles being configured to operate at least one of a first cooling element and a heating element at a different duty cycle. The temperature control unit may also be configured to select an operation profile in the change temperature mode based upon a temperature difference between a target temperature selected by a user and an internal temperature sensed by a first internal temperature sensor.

The temperature control unit may also be configured to enter a sustain temperature mode, wherein the temperature control unit is configured to enter the sustain temperature mode when an external temperature sensed by an ambient temperature sensor differs from at least one of an internal temperature sensed by a first internal temperature sensor and a target temperature selected by a user by at least a second amount but the internal temperature sensed by the first internal temperature sensor does not exceed the target temperature selected by the user by at least the first amount. The sustain temperature mode may comprise a plurality of operation profiles, wherein each of the operation profiles is configured to operate at least one of a first cooling element and a heating element at a different duty cycle, and the temperature control unit may be configured to select an operation profile in a sustain temperature mode based upon a temperature difference between an external temperature sensed by the ambient temperature sensor and at least one of the target temperature selected by the user and the internal temperature sensed by the first internal temperature sensor.

Figure 1:
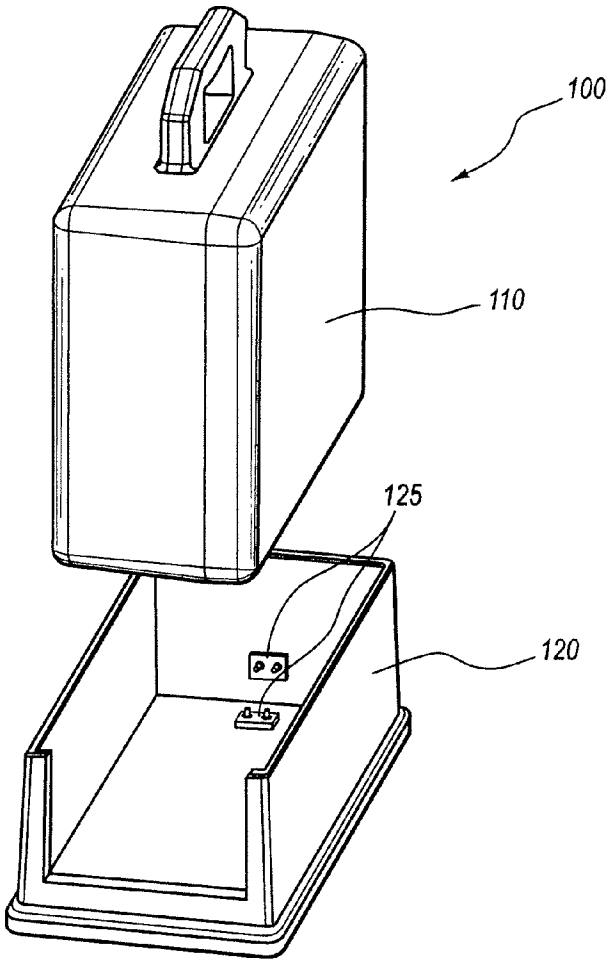
FIG. 1 is a perspective view of one embodiment of a temperature control case system comprising a case and a mounting assembly.

Other specific embodiments of the invention will now be described in greater detail with reference to the accompanying drawings. FIGS. 1 and 2 depict a temperature control case system 100 comprising a case 110 and a mounting assembly 120. Mounting assembly 120 includes electrical connectors 125, which are configured to electrically connect with corresponding female connectors 126 (see FIG. 2) on the case 110. Mounting assembly 120 will typically (but need not necessarily) be positioned within a vehicle with connectors 125 coupled with a power source, such as the vehicle's battery.

Figure 3:
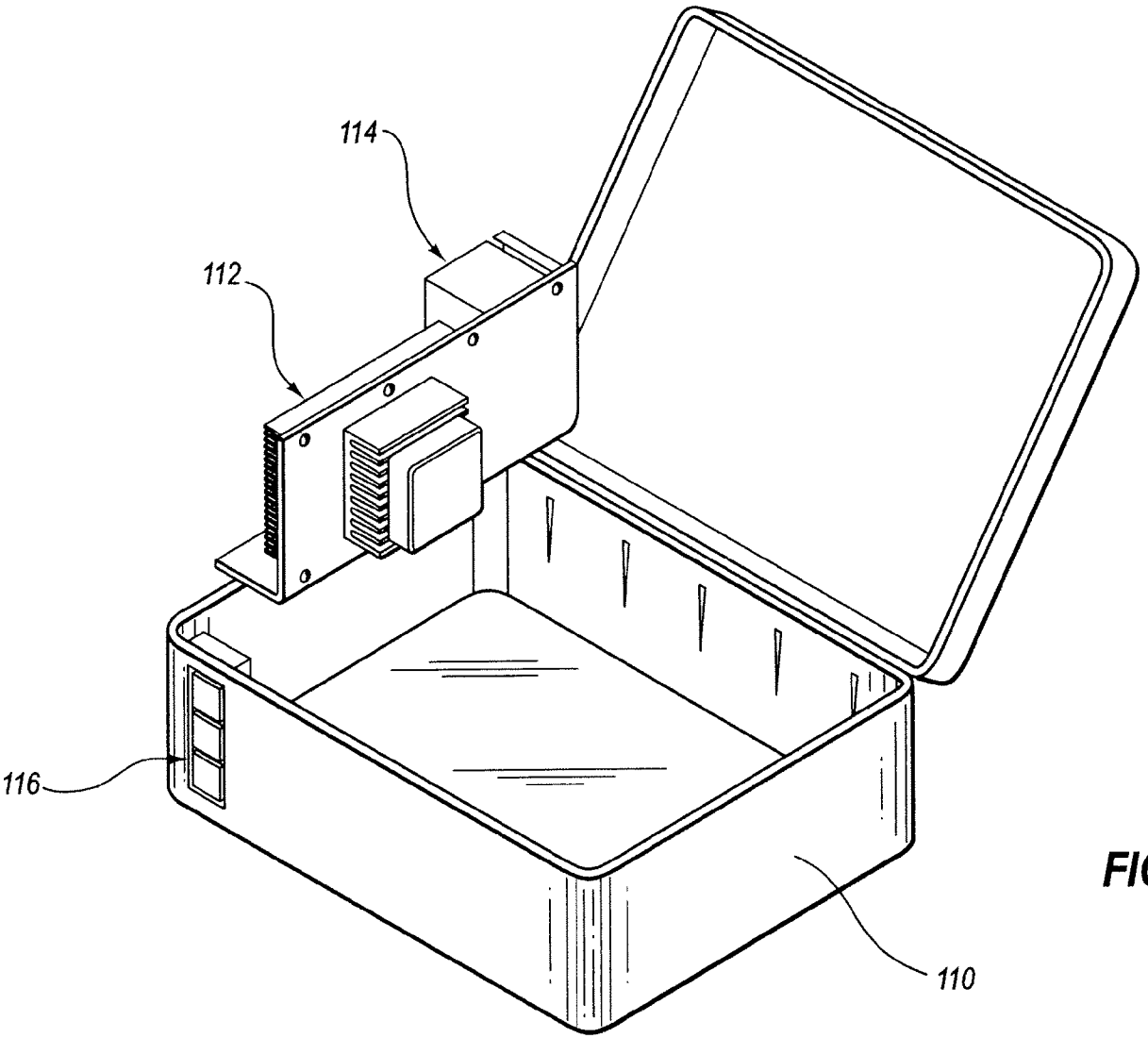
FIG. 3 is a perspective view of one embodiment of a temperature control case showing some components that may be included with the case.

In this manner, when case 110 is received within mounting assembly 120 and electrically coupled with the power source, the heating/cooling unit 112 (see FIG. 3) can be run from the vehicle power source, or another external power source. In addition, the external power source coupled with mounting assembly 120 may be used to charge battery 114, which may be positioned adjacent to heating/cooling unit 112, as shown in FIG. 3. When the case 110 is removed from the mounting assembly 120, the power for running heating/cooling unit 112 is automatically switched to battery 114. Some embodiments of the invention may also include one or more solar panels positioned on the exterior of the case to power the case and/or charge a battery during use.

Mounting assembly 120 may also include one or more brackets, rails, straps, fasteners, etc. (not shown) to allow for the case 110 to be secured and/or locked into placed within the mounting assembly 120. The case 110 itself may also have corresponding rails, grooves, or other features that engage one or more features on the mounting assembly 120 if desired.

Case 110 also includes a control board 116. Control board 116 may contain various elements, such as a CPU, firmware, control circuitry, sensor signal conditioning circuitry, power control circuitry, and/or a user interface, such as an LCD display. In one embodiment, the system may be configured to maintain a default temperature upon startup. The user may be able to adjust the default temperature as needed and can, of course, adjust the temperature away from the default temperature, via the user interface, to any desired temperature within a preconfigured range. The default temperature may also be adjusted in some embodiments so that a user with a consistent storage of medications need not adjust the default each time the case is used. In one embodiment, the preconfigured range within which the case is configured to maintain a desired temperature is between about 25 degrees Fahrenheit and about 125 degrees Fahrenheit. Battery capability can also be monitored by the CPU, the data of which may be available to the user by pressing a "battery status" button or the like on a user interface.

Figure 4:
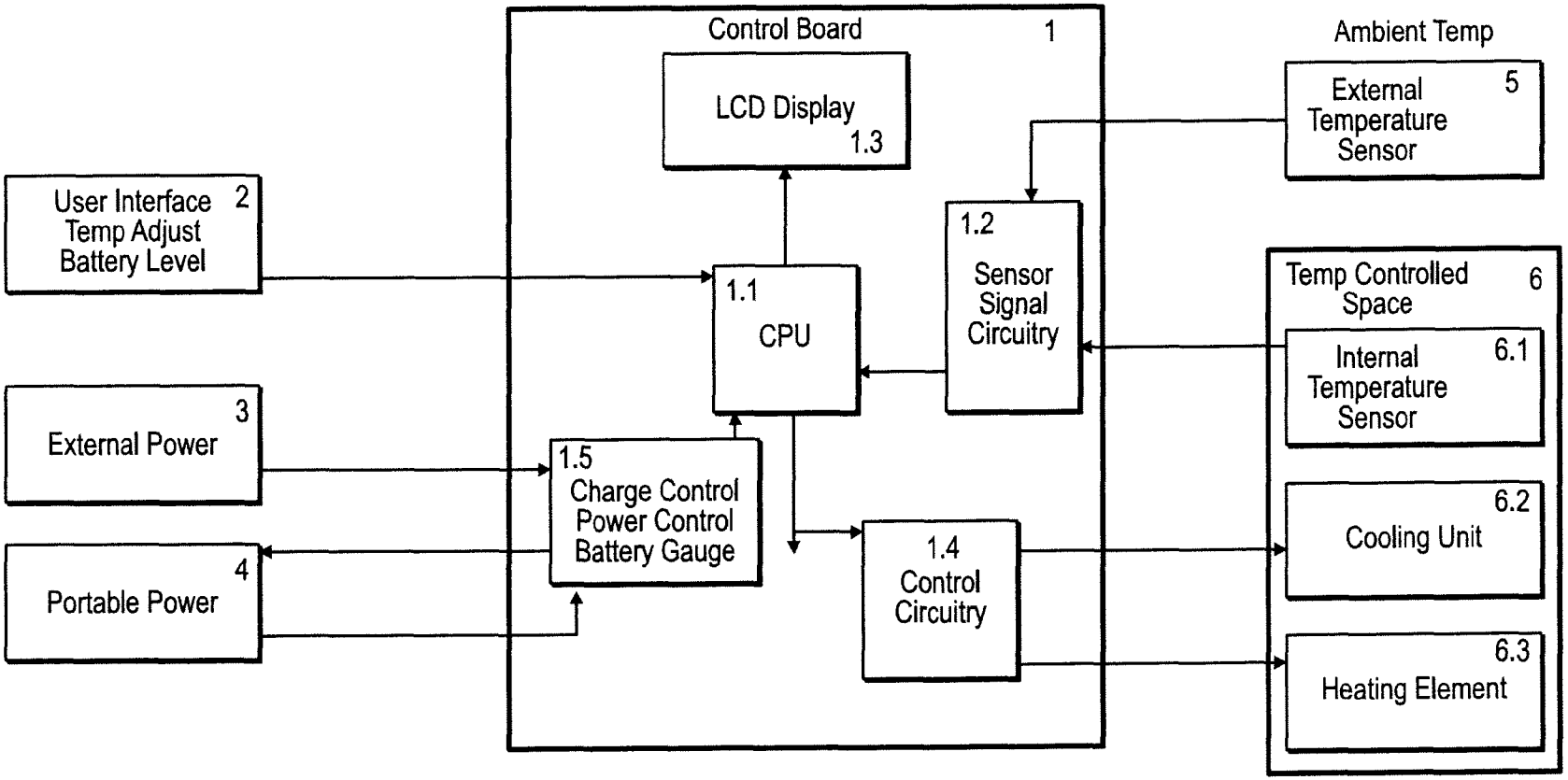
FIG. 4 is an electrical diagram showing an example of a control board and its interactions with various components of one embodiment of a temperature control case.

An example of a control board suitable for use in connection with various embodiments of the invention is shown in the diagram of FIG. 4. The control board 1 contains a CPU 1.1. CPU 1.1 is coupled to sensor signal circuitry 1.2, an LCD display 1.3, control circuitry 1.4, and power control circuitry 1.5. If plugged into external power 3, the system may be configured to operate from the external power, in some cases along with the internal or portable power source 4, through the on-board power controlling circuitry 1.5. Portable power source 4 may comprise one or more batteries in some embodiments. Alternatively, portable power 4 may comprise one or more solar power cells. When external power 3 is removed from the case, the power control circuitry 1.5 may be configured to automatically switch over to portable power 4 while retaining proper operation. In preferred embodiments, the switching from external power 3 to portable power 4 and vice-versa requires no user action or attention other than coupling the case with a mounting assembly or the like. In some embodiments, a cord with a plug may be used to switch power to an external power source. In other embodiments, electrical connectors without a cord may be used, such as connectors 125/126 in FIGS. 1 and 2. Once the electrical connectors have been engaged with corresponding connectors on, for example, a mounting bracket, the power control circuitry 1.5 may automatically switch power from the internal power 4 to the external power source 3. In such embodiments, the user need not be concerned with connecting to the power source as it will take place automatically when the case is returned to its mounting bracket or another mounting assembly.

In some embodiments, if the battery falls below a threshold charge (such as 20%, for example), the CPU 1.1 may be configured to enter a safety mode, which may disable any heating or cooling or may limit the heating or cooling elements in some other manner. This may be accomplished in the control circuitry 1.4 and may be used to prevent battery damage.

The system may be controlled by a user via the user interface 2. User interface 2 may allow for selection of a desired internal temperature, may have display elements showing one or more internal and/or external temperature readings, may display the battery level, and/or may also display a time indicative of the estimated operating time remaining until the heating/cooling unit will shut down unless it is reconnected to an external power source or coupled with a new battery.

The user interface in one specific embodiment consists of an LCD display and a plurality of control buttons or a touch-screen display. The LCD display may be capable of displaying the controlled temperature, the ambient temperature, and the battery level. The buttons may include, for example, a "Display Desired Temperature" button, an "Ambient Temperature" button, a "Battery Level" button, a "Toggle Up" button, and a "Toggle Down" button. In some embodiments, the "Toggle" functions will not activate unless a secondary button—such as the "Display Desired Temperature" button—is also activated. This feature may facilitate prevention of an accidental shift of temperature settings due to an inadvertent press of a toggle button. In such embodiments, upon pressing and holding the "Display Desired Temperature" button (or another secondary button as desired), the user can then push the "Toggle Up" or "Toggle Down" functions until the desired temperature is displayed. Pressing the "Ambient Temperature" button may display the ambient temperature. Pressing the "Battery Level" button may display the current charge level of the battery. The "Battery Level" button may also, or alternatively, display the approximate time left during which the case may be operated with the battery without needing to draw upon an external power source. Of course, a separate button may be provided for displaying the time left for operation of the case with the current battery if desired.

Upon the input of a desired target temperature via the user interface 2, the system may check current internal and external temperatures via the internal 6.1 and external 5 temperature sensors. Software incorporated within the system may then be used to determine the best heating/cooling profile for the conditions. Further details on how the software may operate in some embodiments are provided below.

If the temperature inside the case is higher than the preset temperature, the CPU 1.1 may activate the cooling unit 6.2 via the control circuitry 1.4. The duty cycle on the cooling element may also be adjusted as required to maintain the desired temperature within a more controlled range. Once the desired temperature is reached, the system may continue to decrease (or increase if the internal temperature was originally below the target temperature) the internal temperature by a preconfigured amount for proper hysteresis characteristics. The CPU may apply the same principle for the heating profile(s) using the heating element 6.3. In one embodiment, the desired temperature is "overshot" by 0.5 degrees Fahrenheit so as to maintain an internal temperature that varies by only one degree Fahrenheit.

Examples of suitable software for use in connection with various embodiments of the invention will now be discussed with reference to the flowchart of FIG. 5. The software represented by FIG. 5 may be designed to run the microprocessor of the case. Upon start up, the software may automatically assume a preset desired temperature value, such as 65 degrees Fahrenheit. By pressing a button, such as a "Display Preset" button, this value can be sent to the display. The user can change the preset value by hitting "Up" or "Down" buttons. In some embodiments, the "Up"/"Down" buttons will not change the preset value unless the user is also holding another button, such as the "Display Preset" button.

In one embodiment, the system controls temperature by utilizing three modes: a "Change Temperature" mode, a "Sustain Temperature" mode, and a "Hold" mode. As shown in FIG. 4, once the preset has been assigned, the controlled (internal) and ambient temperatures are read and compared to the preset or desired internal temperature. Based upon these comparisons, one of the three profile modes is selected. For example, if the controlled temperature differs from the preset temperature by a first pre-selected amount, the system may be configured to enter the "Change Temperature" mode. If, on the other hand, the controlled temperature is close enough to the preset temperature within a pre-selected range, the system may be configured to enter one of two other modes, depending upon the ambient temperature. More particularly, If the ambient temperature differs from the controlled temperature by a second pre-selected amount, the system may be configured to enter the "Sustain Temperature" mode. If the ambient temperature does not differ from the controlled temperature by the second pre-selected amount, the system may be configured to enter the "Hold" mode.

Figure 5:
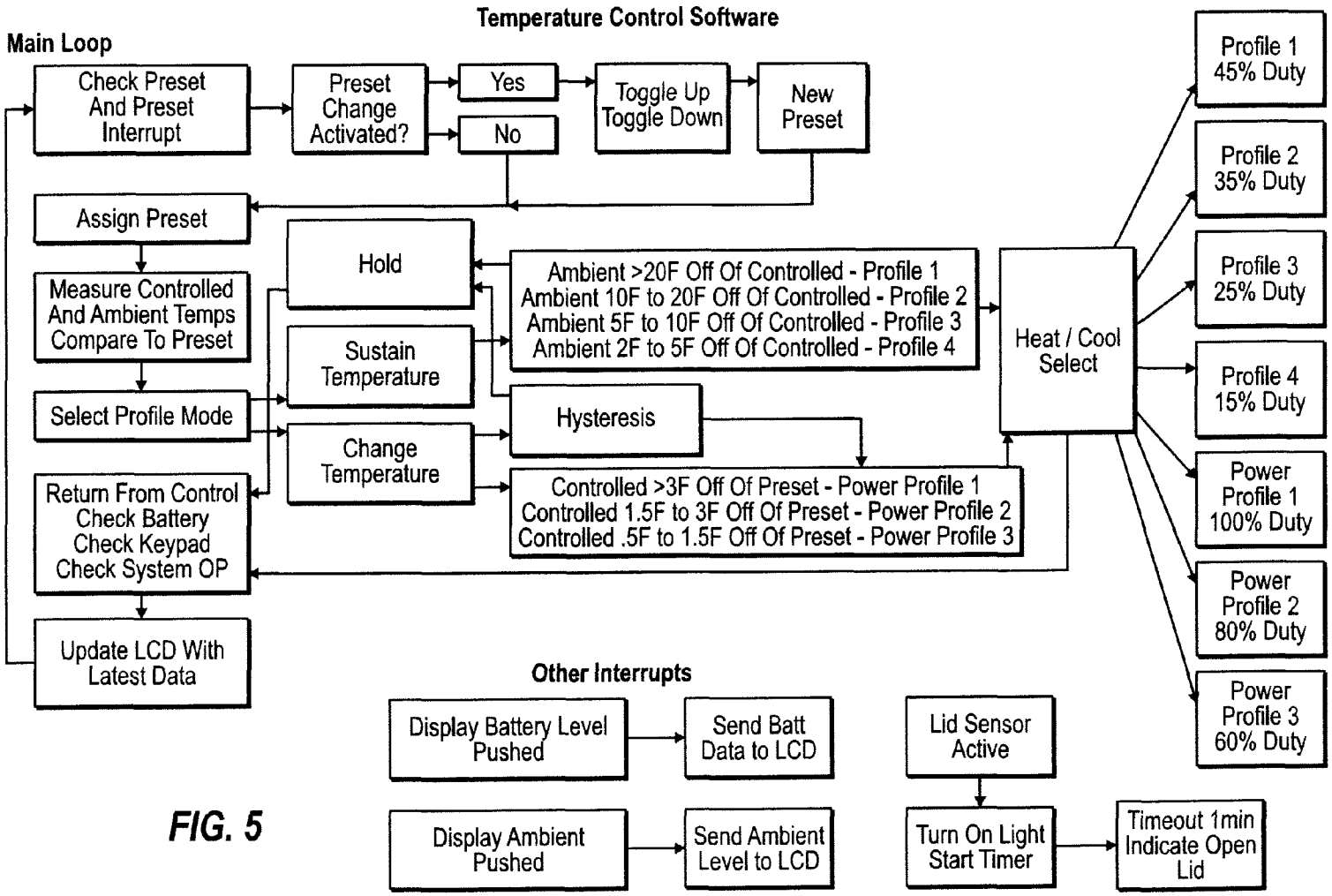
FIG. 5 contains flowcharts demonstrating example operations of one type of temperature control software that may be used in connection with various embodiments of temperature control cases.

Thus, in the example of FIG. 5, if the preset temperature differs from the controlled temperature by at least 0.5 degrees Fahrenheit, the "Change Temperature" mode is entered. If, on the other hand, the preset temperature differs from the controlled temperature by less than 0.5 degrees Fahrenheit, "Sustain Temperature" mode is entered unless the ambient temperature does not differ from the controlled temperature by at least 2 degrees Fahrenheit. If the preset temperature differs from the controlled temperature by less than 0.5 degrees Fahrenheit, and the ambient temperature does not differ from the controlled temperature by at least 2 degrees Fahrenheit, "Hold" mode is entered. Various heating/cooling profiles within the "Change Temperature" mode may be selected depending upon the difference in temperature between the controlled and preset target temperatures. Likewise, various profiles within the "Sustain Temperature" mode may be selected depending upon the difference in temperature between the ambient and controlled temperatures. Of course, those having ordinary skill in the art, after having received the benefit of this disclosure, will appreciate that the comparison may be between the ambient and preset temperatures instead in the "Sustain Temperature" mode. The various heating/cooling profiles within the various modes are discussed in greater detail below.

In the "Change Temperature" mode, the system may be configured to ignore outside temperatures and simply run whichever element is necessary at a high duty cycle (100% if needed) in order to change the temperature inside the case to the preset level. Of course, the system may be configured to overshoot the preset temperature by a pre-selected amount instead, if desired, so as to maintain a suitable temperature range within the case. The duty cycle in some embodiments may be selected according to the difference between the controlled temperature and the preset target temperature. For example, in FIG. 5 it can be seen that if the controlled temperature differs from the preset temperature by more than 3 degrees Fahrenheit, Power Profile 1 is selected. Power Profile 1 sets the cooling (or heating) element to 100% duty cycle. If the controlled temperature differs from the preset temperature by between 1.5 and 3 degrees Fahrenheit, Power Profile 2 is selected, which sets an 80% duty cycle. Finally, if the controlled temperature differs from the preset temperature by between 0.5 and 1.5 degrees Fahrenheit, Power Profile 3 is selected, which sets a 60% duty cycle. Of course, countless variations of the example duty cycles, profiles, temperature ranges, etc. presented above will be apparent to one of ordinary skill in the art after having received the benefit of this disclosure.

After attaining the desired preset temperature, the software may continue to push the temperature past the preset level by a preconfigured amount, such as 0.5 degrees Fahrenheit, to create hysteresis. After this cycle is complete, the system may switch to Hold mode (or to Sustain Temperature mode) using a "Smartsensor" software feature, as described below.

In Hold mode, the system may measure the outside and inside temperatures and wait for the inside temperature to relax towards the ambient temperature by a preconfigured amount, such as one degree Fahrenheit. When the temperature has relaxed towards ambient by this amount, the system may be configured to switch to Sustain Temperature (or Temperature Change) mode. Alternatively, the system may switch to Sustain Temperature mode immediately without waiting for a relaxation if the ambient temperature is outside of a pre-selected range from the controlled (internal) temperature (or the preset temperature). Also, if the controlled temperature relaxes towards the ambient such that it is outside of the Change Temperature range (0.5 degrees Fahrenheit in the example of FIG. 5), the system may be configured to go directly from Hold mode to Change Temperature mode.

In Sustain Temperature Mode, a cooling/heating profile may be selected by the CPU based on the difference between the inside and outside temperatures. In the example software of FIG. 5, if the ambient temperature differs from the controlled temperature by more than twenty degrees Fahrenheit, Sustain Profile 1 is selected. Sustain Profile 1 results in a 45% duty cycle to the heating or cooling element, depending upon whether the ambient temperature is greater than or less than the controlled temperature by more than twenty degrees. If the ambient temperature differs from the controlled temperature by between ten and twenty degrees Fahrenheit, Sustain Profile 2 is selected, which results in a 35% duty cycle. If the ambient temperature differs from the controlled temperature by between five and ten degrees Fahrenheit, Sustain Profile 3 is selected, which results in a 25% duty cycle. If the ambient temperature differs from the controlled temperature by between two and five degrees Fahrenheit, Sustain Profile 4 is selected, which results in a 15% duty cycle. Of course, those of ordinary skill in the art will appreciate that the temperature ranges and duty cycle figures represented in FIG. 4 are for illustration purposes only. A wide variety of alternative configurations will be apparent to those of ordinary skill in the art after receiving the benefit of this disclosure, and may change depending upon a variety of factors, such as the configuration of the case, the sensitivity of the medications in the case to temperature change, the characteristics of the heating/cooling elements, etc.

While in Sustain Temperature mode, the system may remain in the selected profile for as long as the controlled temperature is stable. If the controlled temperature begins to change too rapidly away from ambient (profile too strong), the CPU may be configured to select a profile with a lower duty cycle or switch to Hold mode. Thus, in other embodiments, it may be desirable to have a larger array of profiles/duty cycles available to allow the system greater control for maintaining a precise internal temperature within a narrow range. The system may continue to go through this cycle until the temperature is stable. If all profiles are too strong for the environment, the system may then be configured to enter the Hysteresis mode for 0.5 degrees Fahrenheit (for example), and then switch to Hold mode. If, on the other hand, the controlled temperature begins to shift too rapidly towards the ambient temperature, the CPU may be configured to select a stronger profile. The CPU may continue to go through this cycle until the controlled temperature stabilizes, even utilizing the Power Profiles, as described above, if necessary.

The Smartsensor software feature is designed to keep the temperature inside the case as stable as possible. It may accomplish this by utilizing not only the internal temperature of the case—and/or one or more compartments in the case—but also by utilizing the outside temperature, and, in some cases, the limits of the insulation provided with the case. The Smartsensor software feature may allow the CPU to determine what sort of temperature swing to expect in the near future and adjust the heating/cooling profile accordingly before a loss of temperature regulation occurs, rather than reacting to a change in the internal temperature, which may result in unacceptable temperature swings. By monitoring the ambient and controlled temperatures and comparing them with the preset temperature, the system can select an appropriate profile to maintain the controlled temperature in an efficient manner within an appropriate temperature range.

In some embodiments, a light or other visual or audible indicator may be activated upon detecting that the controlled temperature is within the proper range, e.g., within ±one degree Fahrenheit of the preset temperature. In still other embodiments, a light or other visual or audible indicator may be activated upon detecting that a cooling/heating operation has taken place over a given period of time without generating an expected increase/decrease in the controlled temperature. Additionally, or alternatively, visual and/or audible indicators may be activated upon detecting an internal temperature that is at a predefined unacceptable level.

As also shown in FIG. 5, in some embodiments a lid sensor may be incorporated into the case. In such embodiments, the lid sensor may be used for a variety of purposes. For example, the lid sensor may be coupled with an internal light to illuminate the interior of the case automatically upon opening the lid. The lid sensor may also be coupled with the heating/cooling elements such that, upon opening the lid, the heating/cooling element is shut down to avoid wasting energy while the lid is open. In other embodiments, the heating/cooling element may not be shut down entirely, but may be set to a reduced duty cycle, e.g., 25%. Alternatively, the heating/cooling element may be set to a higher power profile, depending upon the ambient temperature, when an open lid has been identified, in order to provide further temperature protection to the contents of the case while the case is open. In such embodiments, a visual and/or audible indicator, such as an alarm, may be used to let the user know that the case is open and that the heating/cooling elements are working extra hard to make up for the open lid so that energy is not wasted for an unnecessary period of time. The lid sensor may also be coupled with an external light to indicate to the user that the lid is open. As another alternative, activating the lid sensor may start a timer linked with the external light, or another visual or audible indicator, such that only upon reaching a predetermined time period during which the lid has been open will the light be activated.

Figure 6:
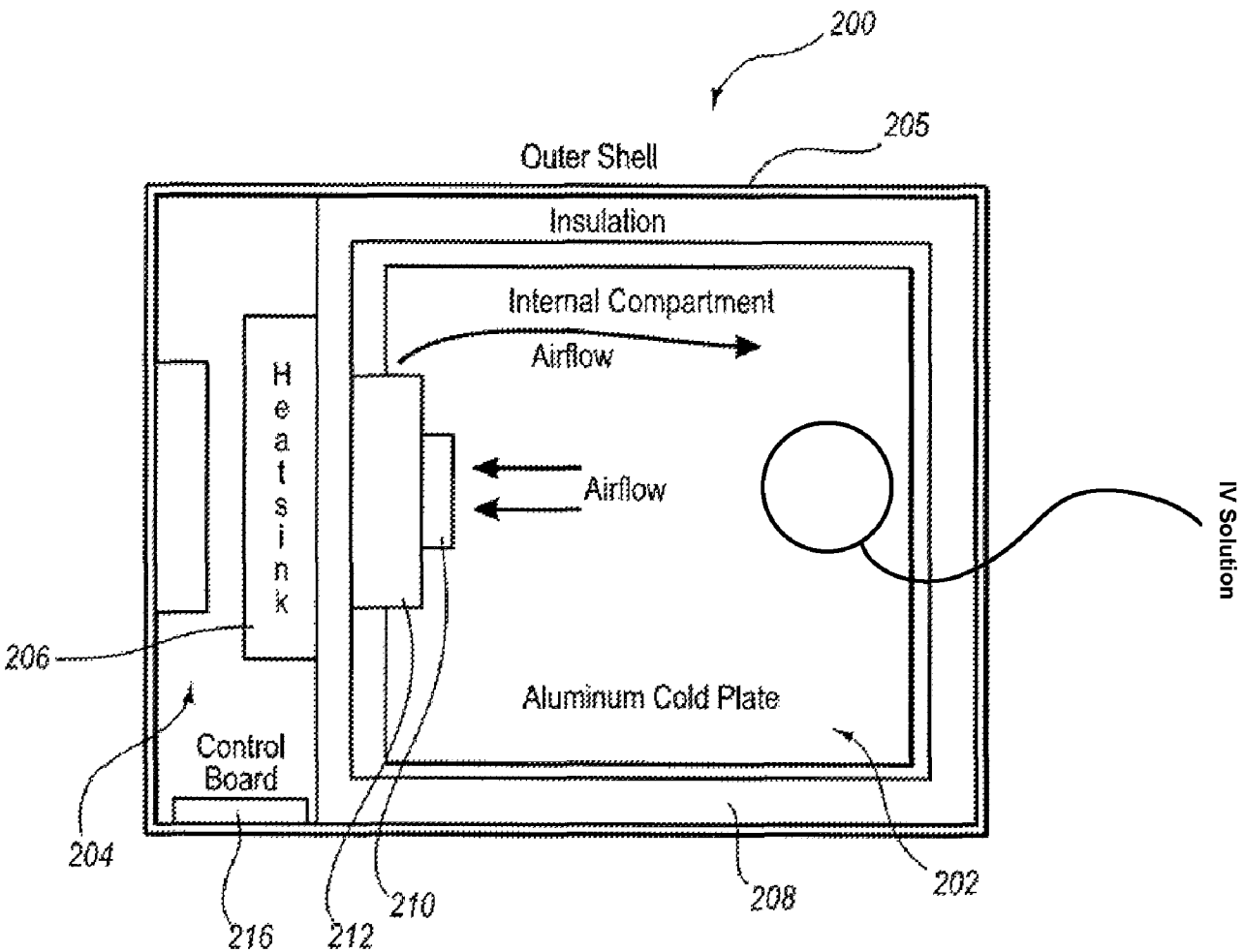
FIG. 6 is a schematic diagram showing an example arrangement of components within one embodiment of a temperature control case.
Figure 7:
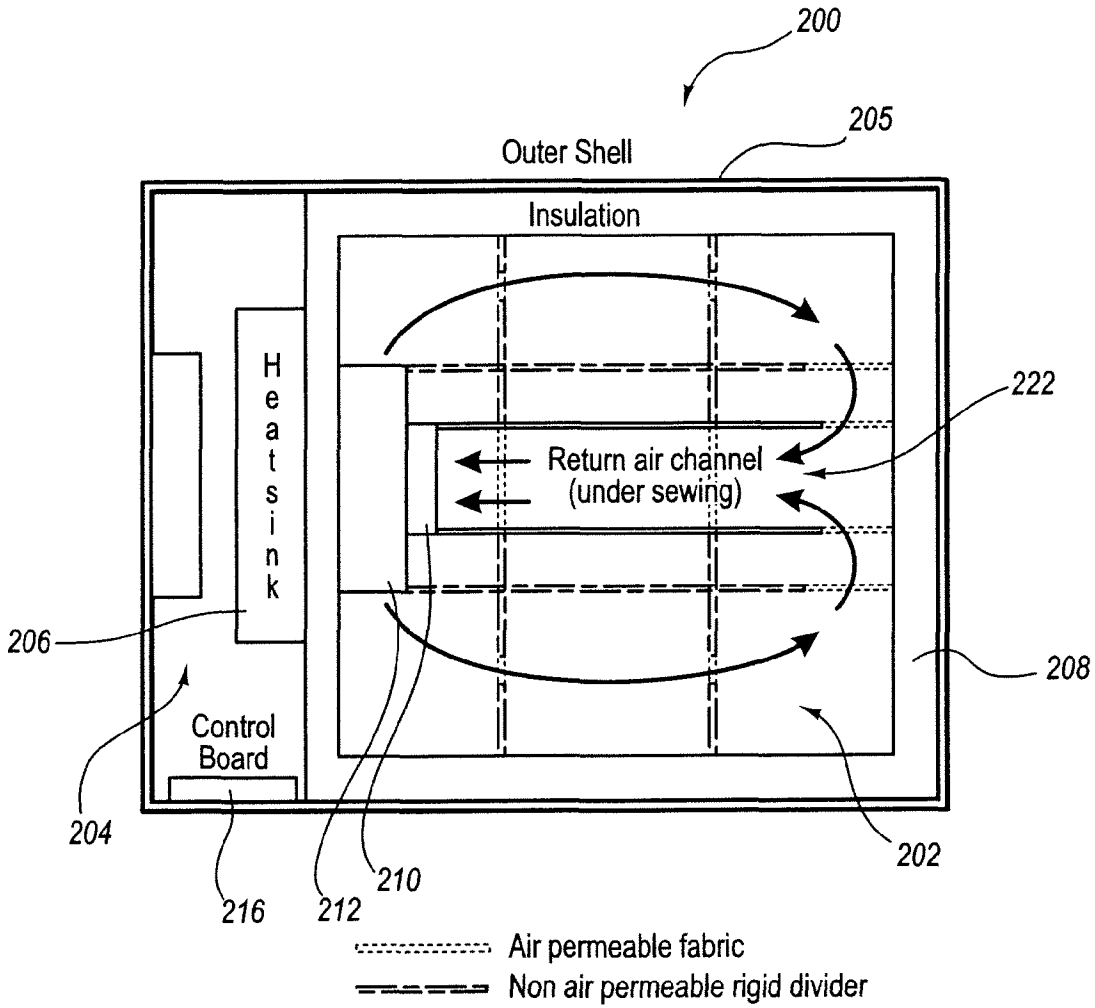
FIG. 7 is a schematic diagram showing the temperature control case of FIG. 6 with an example arrangement of dividers configured to channel airflow throughout an interior compartment of the case.

FIGS. 6 and 7 depict the internal cavity of one embodiment of a temperature control case 200. Temperature control case 200 includes an outer shell 205 enclosing a medication storage compartment 202 and a temperature control circuitry compartment 204. The outer shell 205 may, in some embodiments, be made from a high-impact plastic, such as a copolymer polypropylene molded plastic. In some embodiments, cases made by Pelican™ Products, Inc., or other similar cases, may be used to form the outer shell 205. Compartment 204 contains heatsink 206 and control board 216, as shown in the figures. Of course, a variety of other components may be housed within compartment 204, such as a battery, heating/cooling unit, etc.

A layer of insulation 208 may be used to line the medication storage compartment 202, so as to minimize heat transfer therethrough. A fan 210 and a cold air exchanger 212 may also be provided to promote favorable air flow within compartment 202. In addition, one or more metal plates may be provided to promote an even temperature distribution throughout compartment 202. In some embodiments, aluminum metal plates may be used. In other embodiments, gelpacks or other energy conservation devices may also be used to further facilitate the maintenance of a stable temperature within the case. The case may also be lined, preferably between the outer shell 205 and the insulation 208, with a material that reflects the majority of radiant heat waves. For example, in some embodiments, one or more layers of aluminum bubble film may be positioned adjacent to, or incorporated within, the insulation layer. In other embodiments, the insulation layer may comprise a vacuumed space extending, for example, about the perimeter of compartment 202.

FIG. 7 depicts the internal cavity of temperature control case 200 after a plurality of dividers have been installed in the medication storage compartment 202. The design of the dividers in this embodiment is such that medications can be stored efficiently in sections categorized according to their intended use, composition, or any other suitable arrangement. The design of this embodiment also provides for and promotes good airflow throughout the various sections in compartment 202.

As shown in FIG. 7, compartment 202 is divided into six sections, each of which are separated by a combination of air permeable fabric dividers made of, for example, a mesh material, and rigid, non-air-permeable dividers. The air from return air channel 222 is forced into cold air exchanger 212 by fan 210. The air then exits air exchanger 212 on opposite sides of air exchanger 212, as shown by the arrows in FIG. 7, travels through two air-permeable dividers (and around stored medication), and is pulled back into the return air channel 222 through other air-permeable dividers.

The mesh material may also include an elastic material that facilitates keeping the medications from being dislodged and strewn about within the case. In some embodiments, a plurality of elastic mesh pockets are provided, each intended to store a separate medication.

Case 110 is an example of a means for storing medications. Heating/cooling unit 112 is an example of a means for altering an internal temperature within at least a portion of a compartment. Internal temperature sensor 6.1 is an example of a means for sensing an internal temperature within at least a portion of a compartment. External temperature sensor 5 is an example of a means for sensing an external temperature outside of a temperature-controlled case. User interface 2 is an example of a means for selecting a desired target temperature for at least a portion of a compartment. Control board 116 in FIG. 2 and control board 1 in FIG. 3 are both examples of means for controlling operation of a means for altering an internal temperature. Battery 114 is an example of a portable means for providing power for operation of a temperature-controlled case. Another example of a portable means for providing power for operation of a temperature-controlled case is portable power 4, which, as previously discussed, may comprise one or more solar power cells. LCD display 1.3 is an example of a means for displaying information to a user. Mounting assembly 120 is an example of a means for securing a case within a vehicle. Finally, electrical connectors 125, along with electrical connectors 126 are examples of means for automatically switching a power source for operation of a portable temperature-controlled case from a portable power source to an external power source.

It should be understood that numerous other embodiments are possible. For example, in some embodiments, two or more separate climate-controlled zones or compartments may be provided in a single case. For example, in addition to the primary compartments discussed above, one or more secondary compartments may be provided for maintaining specialized medications that require a different temperature than the other medications in the case and/or require a tighter temperature window. The secondary compartment may be configured to maintain a given temperature regardless of what the ambient temperature is or at a given temperature with the ambient temperature being higher and/or lower than would be possible with respect to the primary compartment. The user may set the secondary compartment(s) temperature(s) independently of the primary compartment(s) temperature(s). Software algorithms that predict temperature swings and act to prevent them before they happen, similar to those discussed above, may also be used for the secondary compartments.

It should also be understood that, although the embodiments described above have a single temperature sensor inside the case, other embodiments are contemplated in which a plurality of internal temperature sensors are used. For example, three internal sensors may be used and each may be positioned in a different location within the storage compartment. This may allow the CPU of the case to perform averaging calculations to get a more precise reading of the overall internal chamber temperature.

The various sensors may also be placed at strategic locations within the case. For example, one sensor may be placed near the heat exchanger. The other, or others, may be placed a relatively large distance from the heat exchanger. If the case detects a great deal of deviation between the various internal sensors, it may be configured to shut the exchanger down and keep the internal fan running. This may allow the fan to circulate air and even out the temperature at the various temperature sensors so as to help prevent the area immediately surrounding the heat exchanger from becoming a "hot spot" or "cold spot."

The above description fully discloses the invention including preferred embodiments thereof. Without further elaboration, it is believed that one skilled in the art can use the preceding description to utilize the invention to its fullest extent. Therefore, the examples and embodiments disclosed herein are to be construed as merely illustrative and not a limitation of the scope of the present invention in any way.

It will be obvious to those having skill in the art that many changes may be made to the details of the above-described embodiments without departing from the underlying principles of the invention. The scope of the present invention should, therefore, be determined only by the following claims.

The invention claimed is:

1. A portable temperature-controlled case, comprising:

an internal storage compartment configured to receive and store an intravenous solution;

a cooling element configured to lower an internal temperature within at least a portion of the internal storage compartment; and an internal temperature sensor configured to sense an internal temperature within at least a portion of the internal storage compartment;

wherein the cooling element is configured to maintain the internal temperature within at least a portion of the internal storage compartment at between 28 and 40 degrees Fahrenheit such that the intravenous solution can be used for therapeutic hypothermia treatment.

2. The temperature-controlled case of claim 1, wherein the cooling element is configured to maintain the internal temperature within at least a portion of the internal storage compartment at between 31 and 40 degrees Fahrenheit.

3. The temperature-controlled case of claim 2, wherein the cooling element is configured to maintain the internal temperature within at least a portion of the internal storage compartment at between 32 and 35 degrees Fahrenheit.

4. The temperature-controlled case of claim 1, further comprising a second internal storage compartment configured to receive and store one or more substances at a different temperature than the internal storage compartment.

5. The temperature-controlled case of claim 4, further comprising an external temperature sensor configured to sense an external temperature outside of the case.

6. The temperature-controlled case of claim 4, further comprising a second internal temperature sensor configured to sense an internal temperature within at least a portion of the second internal storage compartment.

7. The temperature-controlled case of claim 6, further comprising a temperature control unit configured to receive temperature data from the external temperature sensor and at least one of the internal temperature sensors to control operation of the cooling element so as to selectively adjust an internal temperature within at least a portion of at least one of the internal storage compartments.

8. The temperature-controlled case of claim 7, further comprising a heating element, wherein the temperature control unit is further configured to control operation of the heating element so as to selectively adjust an internal temperature within at least a portion of at least one of the internal storage compartments.

9. The temperature-controlled case of claim 1, further comprising a battery configured to provide power for operation of the temperature-controlled case.

10. The temperature-controlled case of claim 9, further comprising an electrical connector configured to be coupled with an external power source, wherein the temperature-controlled case is configured to automatically switch power for operation of the temperature-controlled case from the battery to the external power source upon detecting that the external power source has been coupled with the electrical connector, and wherein the temperature-controlled case is configured to use the external power source to recharge the battery while the external power source is coupled with the electrical connector.

11. The temperature-controlled case of claim 1, further comprising an external temperature sensor configured to sense an external temperature outside of the case.

12. The temperature-controlled case of claim 11, further comprising a temperature control unit configured to receive temperature data from the external and internal temperature sensors to control operation of the cooling element so as to selectively adjust an internal temperature within at least a portion of the internal storage compartment.

13. The temperature-controlled case of claim 12, wherein the temperature control unit is configured with a plurality of operation modes, and wherein the operation of the temperature control unit in at least one of the operation modes depends upon the external temperature sensed by the external temperature sensor.

14. The temperature-controlled case of claim 13, wherein at least one of the operation modes comprises a plurality of operation profiles, and wherein each of the operation profiles is configured to operate the cooling element at a different one of a plurality of duty cycles.

15. The temperature-controlled case of claim 1, further comprising a pressure infusion component for providing pressure infusion of the intravenous solution.

16. A portable temperature-controlled case, comprising:

an internal storage compartment configured to receive and store an intravenous solution;

a cooling element configured to lower an internal temperature within at least a portion of the internal storage compartment;

an internal temperature sensor configured to sense an internal temperature within at least a portion of the internal storage compartment;

an ambient temperature sensor configured to sense an external temperature outside of the case;

a temperature control unit configured to receive temperature data from the internal and ambient temperature sensors and control operation of the cooling element so as to adjust an internal temperature within at least a portion of the internal storage compartment wherein the temperature control element is configured to maintain the internal temperature within at least a portion of the internal storage compartment at a target temperature range, the target temperature range being between 28 and 40 degrees Fahrenheit such that the intravenous solution can be used for therapeutic hypothermia treatment; and a battery configured to provide power for operation of the temperature-controlled case.

17. The portable temperature-controlled case of claim 16, wherein the temperature control unit is configured to alter an operation mode of the cooling unit when the internal temperature sensed by the internal temperature sensor varies from the target temperature range by at least a first amount, and wherein the temperature control unit is configured to alter an operation mode of the cooling unit when the external temperature sensed by the ambient temperature sensor varies from the target temperature range by at least a second amount.

18. The temperature-controlled case of claim 16, wherein the target temperature range is between 31 and 40 degrees Fahrenheit.

19. The temperature-controlled case of claim 18, wherein the target temperature range is between 32 and 35 degrees Fahrenheit.

20. The temperature-controlled case of claim 16, further comprising a second internal storage compartment configured to receive and store one or more substances at a different temperature than the internal storage compartment.

21. A portable temperature-controlled case, comprising:

a base;

a lid configured to enclose the base, wherein at least one of the lid and the base at least partially defines a first internal storage compartment, and wherein at least one of the lid and the base at least partially defines a second internal storage compartment, wherein the second internal storage compartment is configured to receive and store an intravenous solution;

a first cooling element configured to lower an internal temperature within at least a portion of the first internal storage compartment, wherein the first cooling element is configured to operate at a plurality of duty cycles;

a heating element configured to raise an internal temperature within at least a portion of the first internal storage compartment, wherein the heating element is configured to operate at a plurality of duty cycles;

a second cooling element, wherein the second cooling element is configured to maintain the internal temperature within at least a portion of the second internal storage compartment at between 28 and 40 degrees Fahrenheit such that the intravenous solution can be used for therapeutic hypothermia treatment;

a first internal temperature sensor configured to sense an internal temperature within at least a portion of the first internal storage compartment;

a second internal temperature sensor configured to sense an internal temperature within at least a portion of the second internal storage compartment;

an ambient temperature sensor configured to sense an external temperature outside of the case;

a user interface configured to allow a user to select a desired target temperature for at least a portion of the first internal storage compartment;

a temperature control unit configured to receive temperature data from the ambient temperature sensor and at least one of the internal temperature sensors and control operation of the cooling and heating elements so as to adjust an internal temperature within at least a portion of at least one of the internal storage compartments, the temperature control unit comprising:

a change temperature mode, wherein the temperature control unit is configured to enter the change temperature mode when the internal temperature sensed by the first internal temperature sensor differs from the target temperature selected by the user by at least a first amount, wherein the change temperature mode comprises a plurality of operation profiles, each of the operation profiles being configured to operate at least one of the first cooling element and the heating element at a different duty cycle, and wherein the temperature control unit is configured to select an operation profile in the change temperature mode based upon the temperature difference between the target temperature selected by the user and the internal temperature sensed by the first internal temperature sensor; and a sustain temperature mode, wherein the temperature control unit is configured to enter the sustain temperature mode when the external temperature sensed by the ambient temperature sensor differs from at least one of the internal temperature sensed by the first internal temperature sensor and the target temperature selected by the user by at least a second amount but the internal temperature sensed by the first internal temperature sensor does not exceed the target temperature selected by the user by at least the first amount, wherein the sustain temperature mode comprises a plurality of operation profiles, wherein each of the operation profiles is configured to operate at least one of the first cooling element and the heating element at a different duty cycle, and wherein the temperature control unit is configured to select an operation profile in the sustain temperature mode based upon the temperature difference between the external temperature sensed by the ambient temperature sensor and at least one of the target temperature selected by the user and the internal temperature sensed by the first internal temperature sensor; and a battery configured to provide portable power for operation of the temperature-controlled case.

* * * * *